US007954915B2

(12) United States Patent
Teshigawara et al.

(10) Patent No.: US 7,954,915 B2
(45) Date of Patent: Jun. 7, 2011

(54) INK JET RECORDING APPARATUS AND REMAINING INK AMOUNT DETECTING METHOD

(75) Inventors: Minoru Teshigawara, Yokohama (JP); Kiichiro Takahashi, Yokohama (JP); Tetsuya Edamura, Kawasaki (JP); Akiko Maru, Kawasaki (JP); Yoshiaki Murayama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 11/515,712

(22) Filed: Sep. 6, 2006

(65) Prior Publication Data

US 2007/0008351 A1 Jan. 11, 2007

Related U.S. Application Data

(63) Continuation of application No. PCT/JP2006/313915, filed on Jul. 6, 2006.

(30) Foreign Application Priority Data

Jul. 8, 2005 (JP) ..... 2005-199967

(51) Int. Cl.
*B41J 2/195* (2006.01)

(52) U.S. Cl. ..... 347/7; 347/6; 347/19

(58) Field of Classification Search ..... 347/7
See application file for complete search history.

(56) References Cited

U.S. PATENT DOCUMENTS

| | | | | |
|---|---|---|---|---|
| 5,386,224 | A * | 1/1995 | Deur et al. | 347/7 |
| 5,509,140 | A * | 4/1996 | Koitabashi et al. | 347/86 |
| 5,929,885 | A * | 7/1999 | Nakajima et al. | 347/87 |
| 6,024,428 | A | 2/2000 | Uchikata | 347/7 |
| 6,151,039 | A * | 11/2000 | Hmelar et al. | 347/7 |
| 6,474,774 | B1 * | 11/2002 | Okamoto | 347/32 |
| 6,476,926 | B1 | 11/2002 | Yano et al. | 358/1.14 |
| 6,540,314 | B1 | 4/2003 | Sanada et al. | 347/7 |
| 6,554,382 | B1 * | 4/2003 | Sleger | 347/7 |
| 2004/0104949 | A1 * | 6/2004 | Morita et al. | 347/7 |
| 2006/0290723 | A1 * | 12/2006 | Jeong | 347/7 |

FOREIGN PATENT DOCUMENTS

| | | | |
|---|---|---|---|
| JP | 02018056 | A * | 1/1990 |
| JP | 4-275156 | | 9/1992 |
| JP | 7-218321 | | 8/1995 |
| JP | 8-89090 | | 4/1996 |
| JP | 8-112907 | | 5/1996 |
| JP | 9-29989 | | 2/1997 |
| JP | 10-226089 | | 8/1998 |
| JP | 2000-198222 | | 7/2000 |

* cited by examiner

*Primary Examiner* — Matthew Luu
*Assistant Examiner* — Brian J Goldberg
(74) *Attorney, Agent, or Firm* — Fitzpatrick, Cella, Harper & Scinto

(57) ABSTRACT

Even if an error occurred in a result of the detection by an optical detecting mechanism for optically detecting whether or not a remaining amount of ink in an ink tank is equal to or less than a predetermined amount, a correct situation of the remaining ink amount in the ink tank can be detected. A detecting method has a first discriminating step of discriminating whether or not a remaining ink amount in the ink tank is equal to or less than a predetermined amount by using an optical sensor and a second discriminating step of discriminating whether or not the remaining ink amount in the ink tank is equal to or less than the predetermined amount on the basis of information regarding an amount of ink consumed in the ink tank. If the absence of ink is determined in either the first or second discriminating step, information showing the absence of ink is notified.

11 Claims, 7 Drawing Sheets

INK JET RECORDING APPARATUS AND REMAINING INK AMOUNT DETECTING METHOD

This application is a continuation of International Application No. PCT/JP2006/313915, filed Jul. 6, 2006, which claims the benefit of Japanese Patent Application No. 2005-199967, filed Jul. 8, 2005.

BACKGROUND OF THE INVENTION

1. Field of the Invention

The invention relates to a recording apparatus for recording an image by applying ink which is supplied from an ink tank onto a recording medium and a detecting method of a remaining amount of the ink in the ink tank and, more particularly, to a recording apparatus having a detecting mechanism which can detect that the remaining amount of the ink in the ink tank is equal to or less than a predetermined amount and a remaining ink amount detecting method.

2. Description of the Related Art

Hitherto, a method of optically detecting whether or not a remaining amount of ink in an ink tank for enclosing the ink is equal to or less than a predetermined amount or a method of optically detecting the presence or absence of the ink has been known. For example, in Japanese Patent Application Laid-Open No. H08-112907, there has been disclosed a method whereby in order to detect a remaining amount of ink in an ink tank having a negative pressure generating member (absorber), light is made to pass through a part of a light transmissive ink tank wall surface and a change in light reflectance of a boundary portion between the wall surface and the negative pressure generating member is detected.

In Japanese Patent Application Laid-Open No. H07-218321, there has been disclosed an ink tank having an optical ink detecting section which is formed by a light transmissive member made of the same material as that of the ink tank in which an interface with ink and which has a predetermined angle from an optical path. Further, in Japanese Patent Application Laid-Open No. H09-29989 or Japanese Patent Application Laid-Open No. 2000-198222, there has been disclosed a technique for detecting the presence or absence of ink and the presence or absence of an ink tank by one photosensor in which a light emitting device and a light receiving device are constructed in common.

In addition, in Japanese Patent Application Laid-Open No. H07-89090, there has been disclosed an apparatus for detecting the presence or absence of a liquid enclosed in a liquid enclosing container having a negative pressure generating member enclosing chamber and a liquid enclosing chamber communicating with the negative pressure generating member enclosing chamber.

A conventional remaining ink amount detecting mechanism using a light transmissive prism will be described with reference to FIG. 6. FIG. 6 is a diagram showing a positional relation among a light transmitting type prism 1060 provided for a bottom surface 1061 of an ink tank, a light emitting device 1062 for irradiating light to the prism, and a light receiving device 1063 for receiving the light. As shown in FIG. 6, the prism 1060 is provided on the bottom surface 1061 of the ink tank. The light from the light emitting device 1062 enters the prism 1060 from an external lower position of the ink tank.

If the ink tank has sufficiently been filled with the ink, the incident light passes along a path of [an optical path (1)→an optical path (2)'] and is not returned to the light receiving device 1063. On the contrary, if the ink has been consumed and the little ink remains in the ink tank, the incident light is reflected by an oblique side portion of the prism 1060, passes along a path of [the optical path (1)→an optical path (2)→an optical path (3)], and reaches the light receiving device 1063. As mentioned above, the presence or absence of the ink is detected by checking whether or not the light irradiated from the light emitting device 1062 is returned to the light receiving device 1063. The light emitting device 1062 and the light receiving device 1063 are provided on the recording apparatus main body side.

The optical remaining ink amount detecting mechanism described above can be considered to be a rational method as a method whereby whether or not the remaining amount of the ink in the ink tank is equal to or less than the predetermined amount is discriminated or the presence or absence of the ink is detected at low costs.

Further features of the present invention will become apparent from the following description of exemplary embodiments (with reference to the attached drawings).

SUMMARY OF THE INVENTION

Under an environment of a high temperature, dispersibility of a coloring agent in the ink becomes unstable and the coloring agent is liable to be adsorbed into an inner wall of the ink tank. Particularly, such a phenomenon is typical in the case of using ink of a dispersed system. As ink of the dispersed system, for example, there can be mentioned: water pigment ink in which a pigment as a coloring agent has been dispersed into the water by a dispersing agent; water pigment ink using a pigment of a self-dispersing type in which by improving the surface of the pigment, the pigment can be stably dispersed without using the dispersing agent. Further, microemulsion ink in which an oil dye has been emulsion-dispersed is also incorporated in the ink of the dispersed system.

As mentioned above, if the coloring agent has been adsorbed into the inner wall of the ink tank, the light which entered the ink tank is absorbed by the coloring agent. Thus, in spite of the state where no ink remains in the liquid enclosing chamber of the ink tank, it is erroneously determined that the ink still remains. If such an erroneous decision occurs, it is difficult to notify the user of the absence of ink at proper timing.

The invention is made in consideration of such a problem. In a construction using a detecting mechanism which can optically detect whether or not a remaining ink amount is equal to or less than a predetermined amount, it is an object of the invention to provide a recording apparatus in which even in the case where a coloring agent has been adhered onto an inner wall of a tank and the optical detection cannot be accurately performed, it is possible to detect that the remaining ink amount is equal to or less than the predetermined amount and to provide a remaining ink amount detecting method.

Another object of the invention is to provide an ink jet recording apparatus and a remaining ink amount detecting method which can properly notify the user of when the exhaustion of ink occurs.

To accomplish the above objects, according to the invention, there is provided a recording apparatus for recording an image on a recording medium by applying ink which is supplied from an ink tank, comprising: first detecting means adapted to optically detect whether or not an ink amount in the ink tank is equal to or less than a predetermined amount; second detecting means adapted to detect whether or not the ink amount in the ink tank is equal to or less than the predetermined amount on the basis of information corresponding to an amount of ink consumed by a recording operation and a recovery operation; and notifying means adapted to notify of information showing that the ink amount in the ink tank is equal to or less than the predetermined amount if it is detected by either the first detecting means or the second detecting means that the ink amount in the ink tank is equal to or less than the predetermined amount.

According to the invention, there is provided a recording apparatus for recording an image on a recording medium by applying ink which is supplied from an ink tank onto a recording medium, comprising: first discriminating means adapted to discriminate whether or not an ink amount in the ink tank is equal to or less than a predetermined amount by using an optical sensor; calculating means adapted to calculate a value corresponding to an amount of ink consumed in the ink tank; and second discriminating means adapted to discriminate whether or not the ink amount in the ink tank is equal to or less than the predetermined amount on the basis of the calculated value, wherein even when it is determined by the first discriminating means that the ink amount in the ink tank is larger than the predetermined amount, if it is determined by the second discriminating means that the ink amount in the ink tank is equal to or less than the predetermined amount, information showing that the ink amount in the ink tank is equal to or less than the predetermined amount is notified.

According to the invention, there is provided a recording apparatus for recording an image on a recording medium by applying ink which is supplied from an ink tank, comprising: a light emitting device adapted to irradiate light to a prism provided in an ink enclosing chamber in the ink tank; a light receiving device adapted to receive the reflection light from the prism; first discriminating means adapted to discriminate the presence or absence of the ink in the ink enclosing chamber on the basis of the presence or absence of light receiving of the light receiving device; and second discriminating means adapted to discriminate the presence or absence of the ink in the ink enclosing chamber on the basis of information regarding an amount of ink consumed in the ink tank, wherein if the absence of the ink is determined by either the first discriminating means or the second discriminating means, information indicative of the absence of the ink is notified.

According to the invention, there is provided a method of detecting a remaining amount of ink in an ink tank mounted in a recording apparatus, comprising: a first detecting step of optically detecting whether or not the ink amount in the ink tank is equal to or less than a predetermined amount; a second detecting step of detecting whether or not the ink amount in the ink tank is equal to or less than the predetermined amount on the basis of information corresponding to an amount of ink consumed by a recording operation and a recovery operation; and a notifying step of notifying of information showing that the ink amount in the ink tank is equal to or less than the predetermined amount if it is detected in either the first detecting step or the second detecting step that the ink amount in the ink tank is equal to or less than the predetermined amount.

According to the invention, there is provided a method of detecting a remaining amount of ink in an ink tank mounted in a recording apparatus, comprising: a first discriminating step of discriminating whether or not the ink amount in the ink tank is equal to or less than a predetermined amount by using an optical sensor; a calculating step of calculating a value corresponding to an amount of ink consumed in the ink tank; and a second discriminating step of discriminating whether or not the ink amount in the ink tank is equal to or less than the predetermined amount on the basis of the calculated value, wherein even when it is determined in the first discriminating step that the ink amount in the ink tank is larger than the predetermined amount, if it is determined in the second discriminating step that the ink amount in the ink tank is equal to or less than the predetermined amount, information showing that the ink amount in the ink tank is equal to or less than the predetermined amount is notified.

According to the invention, there is provided a method of detecting a remaining amount of ink in an ink tank mounted in a recording apparatus having a light emitting device for irradiating light to a prism provided in an ink enclosing chamber in the ink tank and a light receiving device for receiving the reflection light from the prism, comprising: a first discriminating step of discriminating the presence or absence of the ink in the ink enclosing chamber on the basis of the presence or absence of the light receiving of the light receiving device; and a second discriminating step of discriminating the presence or absence of the ink in the ink enclosing chamber on the basis of information regarding an amount of ink consumed in the ink tank, wherein if the absence of the ink is determined in either the first discriminating step or the second discriminating step, information indicative of the absence of the ink is notified.

According to the invention, even if an error occurred in a result of the detection by the optical detecting mechanism for optically detecting whether or not the remaining amount of ink in the ink tank is equal to or less than the predetermined amount, the correct situation of the remaining amount of ink in the ink tank can be detected. Therefore, it is possible to notify at proper timing that the remaining amount of ink in the ink tank is equal to or less than the predetermined amount.

Further features of the present invention will become apparent from the following description of exemplary embodiments (with reference to the attached drawings).

DESCRIPTION OF THE EMBODIMENTS

A preferred embodiment of the invention will be described in detail hereinbelow with reference to the drawings.

Figure 1:
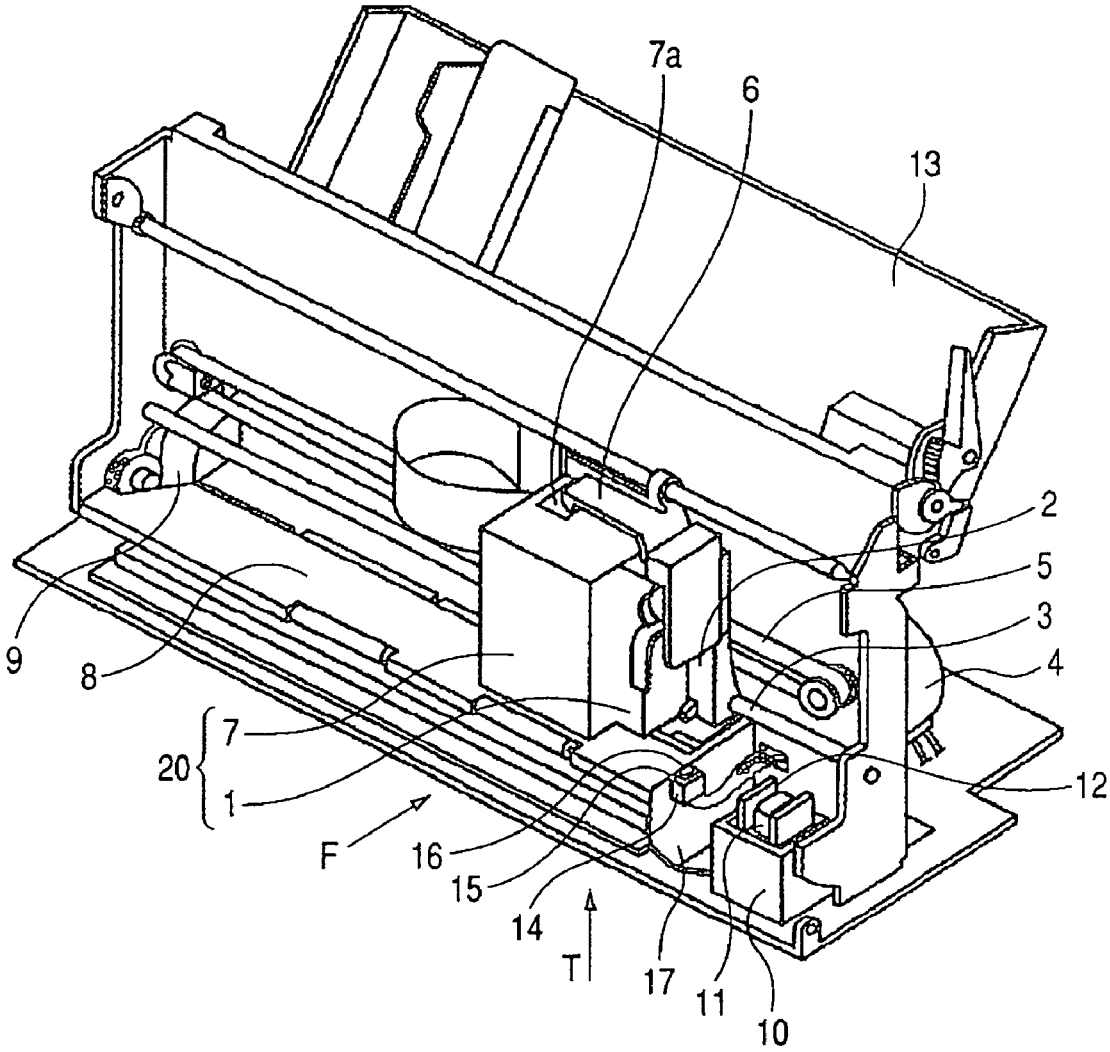
FIG. 1 is a perspective view showing a schematic construction of a recording apparatus.
Figure 5:
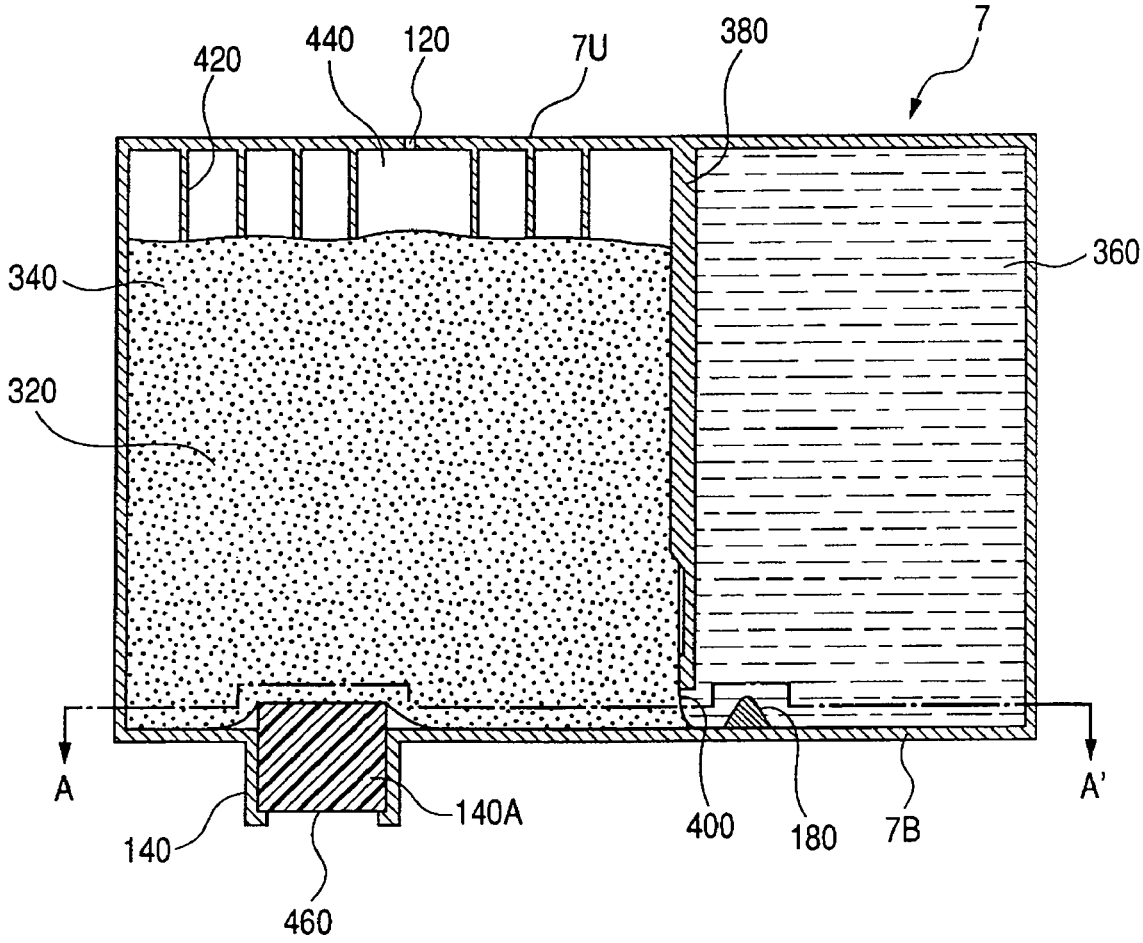
FIG. 5 is a side sectional view showing an internal structure of the ink tank 7.
Figure 6:
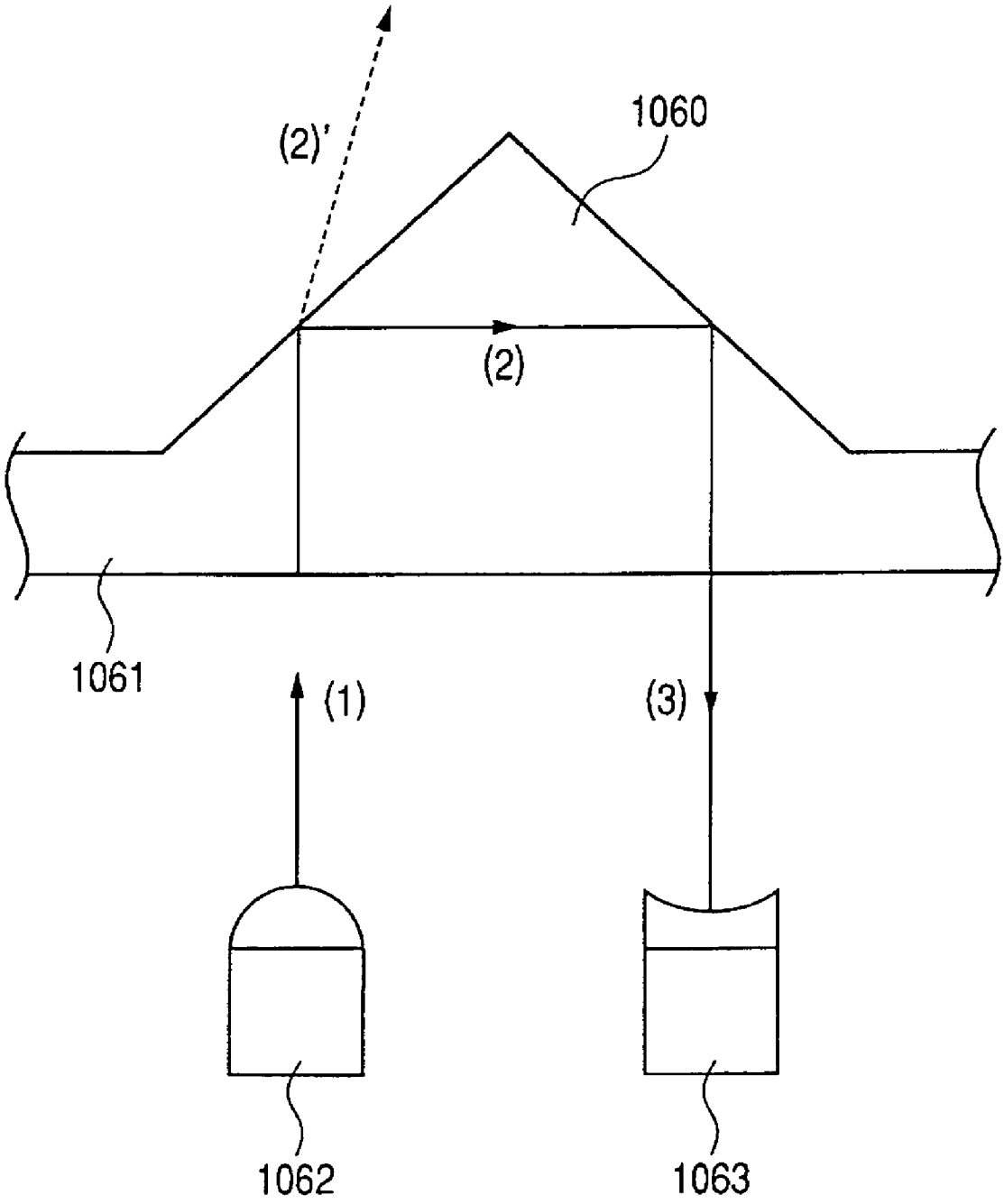
FIG. 6 is a diagram showing a positional relation among a light transmitting type prism provided for a bottom surface of the ink tank, a light emitting device for irradiating light to the prism, and a light receiving device for receiving the light.

FIG. 1 is a perspective view showing a schematic construction of a recording apparatus having a recording head for recording in accordance with an ink jet system as a typical embodiment of the invention. As shown in FIG. 1, an ink cartridge 20 is constructed by a recording head 1 and an ink tank 7 for supplying ink to the recording head. Although the ink cartridge 20 has a construction in which the recording head 1 and the ink tank 7 can be separated, it can also have a construction in which the recording head and the ink tank are integrated, as will be explained hereinafter. An optical prism 180 to detect a remaining ink amount is provided on a bottom surface of the ink tank 7 as shown in FIG. 5, which will be explained hereinafter. The recording head 1 has a recording device (for example, electrothermal converting element, piezoelectric element, or the like) for allowing ink to be discharged.

In FIG. 1, the recording head 1 is mounted on a carriage 2 in a position adapted to discharge the ink downwardly in the diagram. While the carriage 2 is moved (scanned) along a guide shaft 3, an ink droplet is discharged, thereby forming an image onto a recording medium (not shown) such as recording paper. The movement of the carriage 2 to the right and left (reciprocal movement) is performed by the rotation of a carriage motor 4 through a timing belt 5. An engaging claw 6 is provided for the carriage 2. The engaging claw 6 is come into engagement with an engaging hole 7*a* of the ink tank, thereby fixing the ink tank 7 to the carriage 2.

When the recording corresponding to the scan of the recording head 1 is finished, the recording operation is interrupted. The recording medium locating on a platen 8 is conveyed by a predetermined amount by the driving of a feed motor 9. Subsequently, while the carriage 2 is moved again along the guide shaft 3, an image corresponding to the next one scan is formed. A driving force of the feed motor 9 is transferred not only to an inherent recording medium conveying mechanism but also to an automatic sheet feeder (ASF) 13.

A recovery device 10 to execute the recovery operation for keeping a good ink discharge state of the recording head 1 is arranged on the right side of the apparatus main body. The recovery device 10 has: a cap 11 for capping the recording head 1; a wiper 12 for wiping an ink discharge surface of the recording head 1; a suction pump (not shown) for sucking the ink from an ink discharge nozzle of the recording head 1; and the like.

Further, an optical unit 14 constructed by an infrared LED (light emitting device) 15 and a phototransistor (light receiving device) 16 is provided beside the recovery device 10. The light emitting device 15 and the light receiving device 16 are arranged in parallel along the conveying direction (direction shown by an arrow F) of the recording paper. The optical unit 14 is attached to a chassis 17 of the apparatus main body. When the ink cartridge 20 is mounted on the carriage 2 and moved to the right than a position shown in FIG. 1, the ink cartridge 20 is positioned over the optical unit 14. Light is emitted from the light emitting device 15 toward the bottom surface of the ink tank 7. It is detected that a remaining amount of the ink in the tank is equal to or less than a predetermined amount on the basis of a result of the receiving of the light receiving device 16. In the embodiment, particularly, the presence or absence of the remaining ink in a liquid enclosing chamber (ink enclosing chamber) 360 of the tank is detected.

Subsequently, a control construction for executing recording control of the recording apparatus shown in FIG. 1 will be described.

Figure 2:
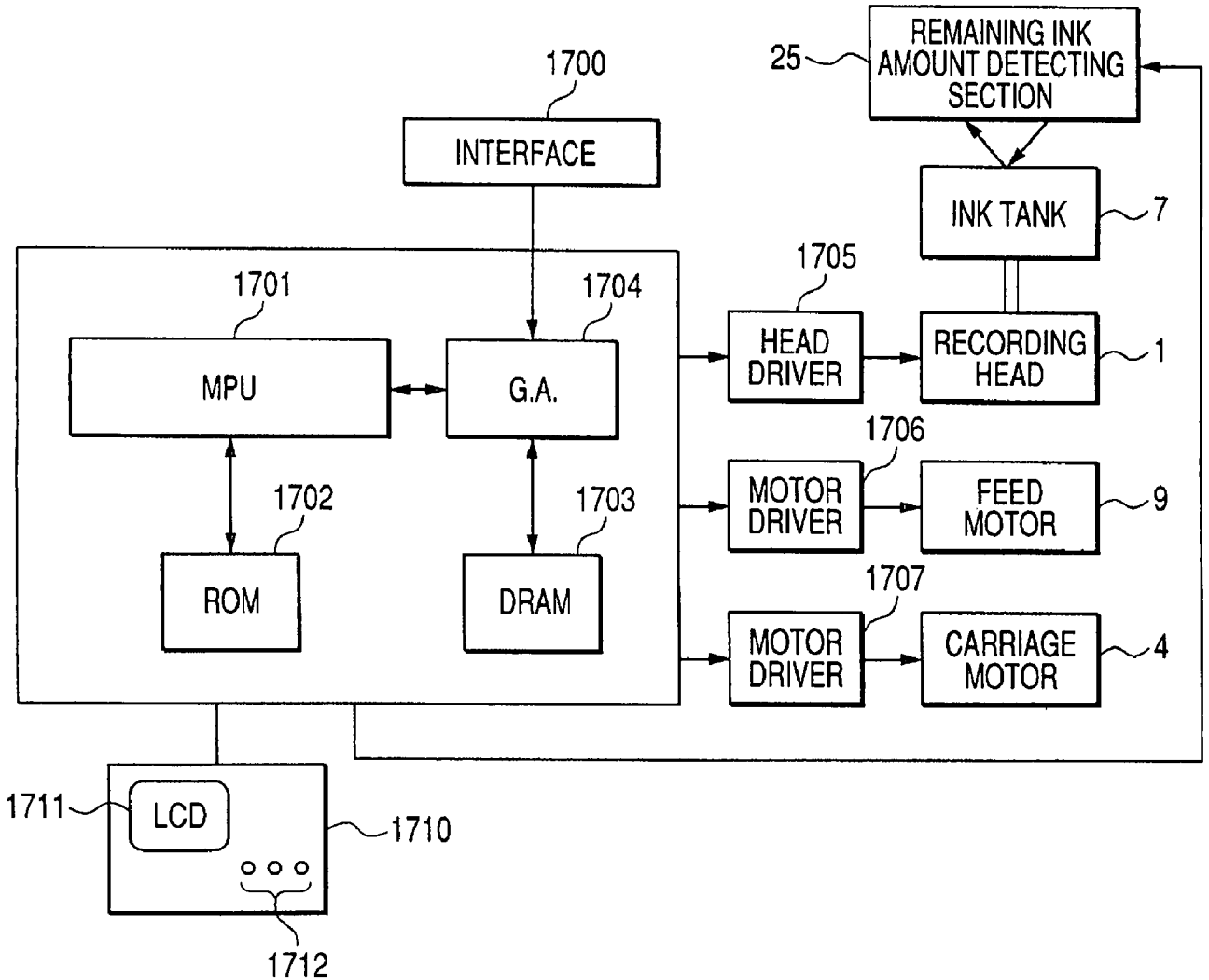
FIG. 2 is a diagram for explaining a control construction for executing recording control of the recording apparatus.

FIG. 2 is a block diagram showing a construction of a control circuit of the recording apparatus. Reference numeral 1700 denotes an interface for inputting a recording signal from a host apparatus; 1701 an MPU for controlling each section of the apparatus; 1702 a ROM in which a control program which is executed by the MPU 1701 has been stored; 1703 a DRAM for storing various data (the recording signal, recording data which is supplied to the recording head 1, and the like); and 1704 a gate array (G.A.) for controlling the supply of the recording data to the recording head 1. The gate array 1704 also controls data transfer among the interface 1700, MPU 1701, and RAM 1703. Reference numeral 1705 denotes a head driver to drive the recording head 1 and 1706 and 1707 indicate motor drivers for driving the feed motor 9 and the carriage motor 4, respectively.

The operation of the above control construction will be described. When the recording signal is inputted to the interface 1700, the recording signal is converted into the recording data for printing between the gate array 1704 and the MPU 1701. The motor drivers 1706 and 1707 are driven under the control of the MPU 1701 and the recording head 1 is driven in accordance with the recording data sent to the head driver 1705, so that the recording is performed.

Reference numeral 1710 denotes a display section having: an LCD 1711 for displaying various messages regarding the recording operation and the state of the recording apparatus; and an LED lamp 1712 of various colors for notifying the apparatus of the recording operation and the state of the recording apparatus.

Liquid droplet number detecting means, what is called, a dot counter (not shown) for counting the number of ink droplets discharged from the recording head is provided for the gate array 1704. The dot counter can count both of the number of ink droplets which are discharged to form an image and the number of ink droplets which are discharged for a preliminary discharge which is executed as a part of a recovery process.

In the embodiment, since consumed ink amounts in each ink tank in various suction recovery processes have previously obtained by experiments, the consumed ink amount in the case where the suction recovery process has been executed can be managed every ink tank. Therefore, in the embodiment, the amount of consumed ink can be calculated by summing the amount obtained by multiplying the number of dots counted by the dot counter mentioned above by an amount of the ink droplet and the consumed ink amount in association with the suction recovery process. This calculation is also executed by the gate array 1704.

As mentioned above, in the embodiment, the amount of ink consumed by the recording operation and the recovery operation is calculated by a data arithmetic operation. Means having such a calculating function is called "consumed ink amount calculating means". The consumed ink amount calculating means is included in the gate array 1704.

The calculated consumed ink amount is written into a memory area (not shown) of the ink tank 7 mentioned above at predetermined timing. In the present recording apparatus, by writing the information similar to that mentioned above into a non-volatile memory (EEPROM) equipped for the recording apparatus, the information can be backed up. The operation of a remaining ink amount detecting section 25 for detecting the presence or absence of the remaining ink amount in the liquid enclosing chamber 360 of the ink tank 7 integrated with the recording head 1 is controlled by the MPU 1701. The remaining ink amount detecting section 25 will be described in detail hereinafter.

Figure 3A:
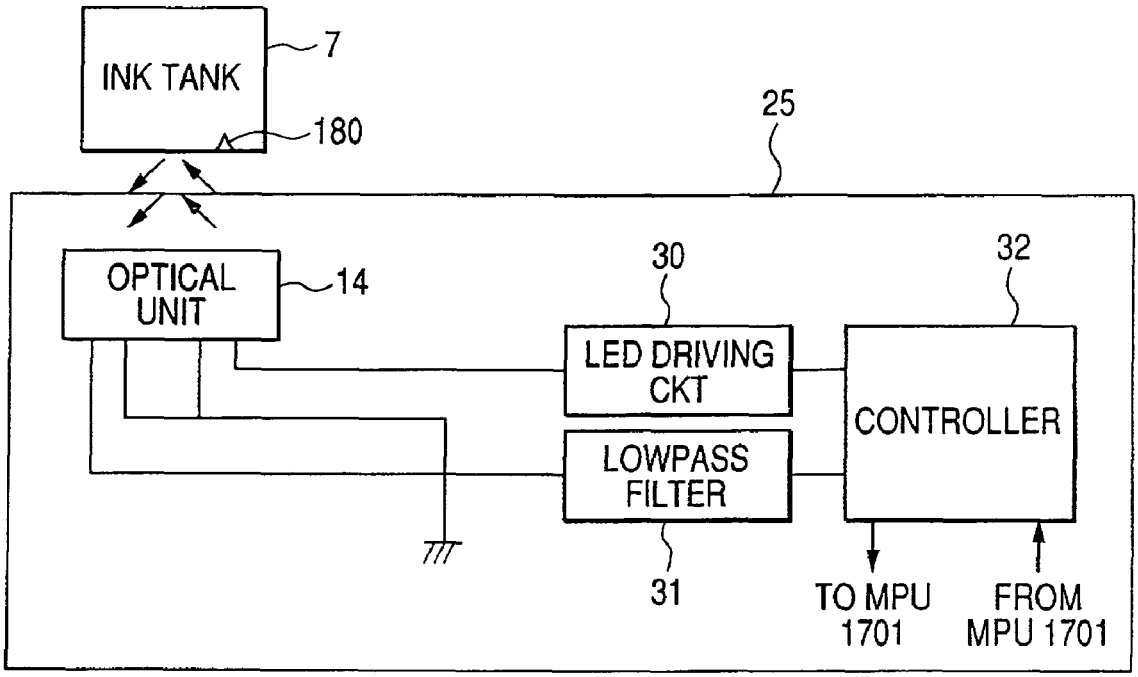
FIGS. 3A and 3B are block diagrams showing a detailed construction of a remaining ink amount detecting section 25.
Figure 3B:
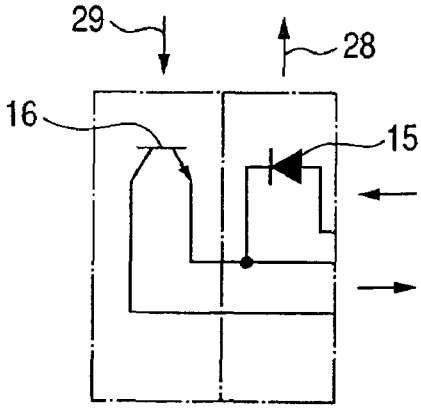

FIGS. 3A and 3B are block diagrams showing a detailed construction of the remaining ink amount detecting section 25.

In the construction shown in FIG. 3A, on the basis of a control signal from the MPU 1701, a controller 32 outputs a pulse signal of a predetermined duty (DUTY) ratio (%) to an LED driving circuit 30. In accordance with the duty ratio, the LED driving circuit 30 drives the light emitting device 15 constructing the optical unit 14 so as to irradiate infrared light onto a bottom portion of the ink tank 7.

The infrared light is reflected by the optical prism (hereinafter, simply referred to as a prism) 180 and returned to the light receiving device 16 constructing the optical unit 14. The light receiving device 16 as a phototransistor converts the received light into an electric signal and outputs the electric signal to a low pass filter (LPF) 31. The LPF 31 cuts high frequency noises in the electric signal inputted from the light receiving device 16 and sends only the signal of low frequencies to the controller 32. The controller 32 A/D-converts the output signal from the LPF 31 into a digital signal. Converted digital values are transferred to the MPU 1701.

As shown in FIG. 3B, the light emitting device 15 is an LED for emitting infrared light 28 and the light receiving device 16 is a phototransistor for receiving infrared light 29 and outputting an electric signal in accordance with a light receiving intensity. As shown in FIG. 1, the LED and the phototransistor are arranged in parallel along the conveying direction of the recording paper.

Figure 4A:
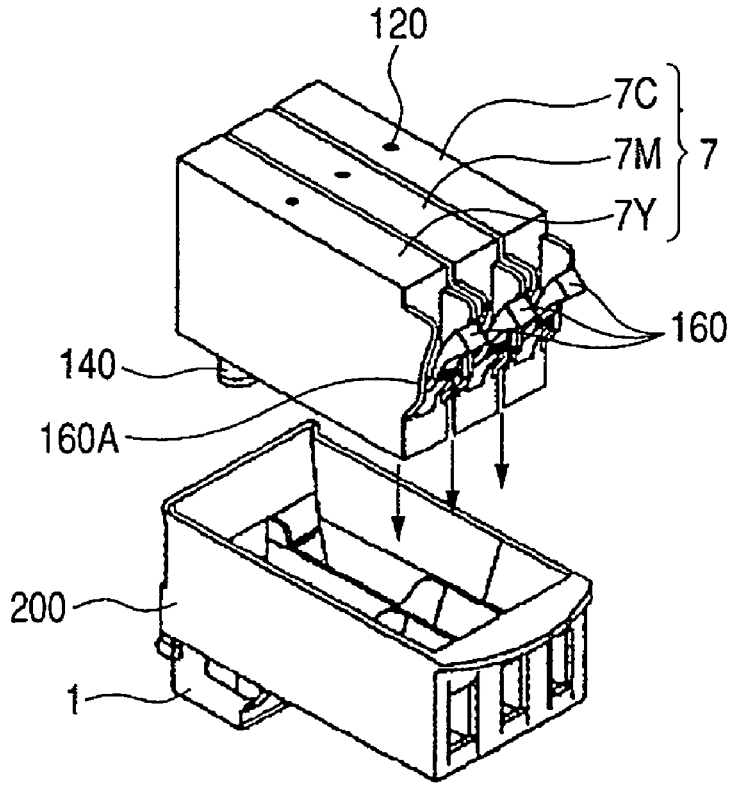
FIGS. 4A and 4B are external perspective view of a head holder 200 having an ink tank 7 and a recording head 1.
Figure 4B:
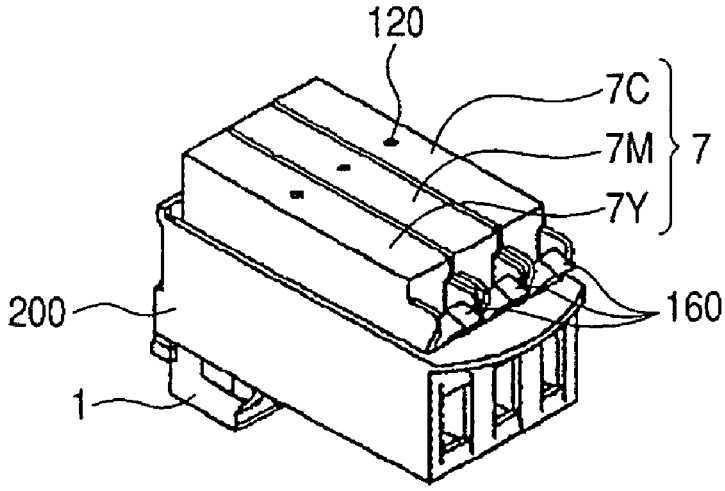

An outline of a construction of the ink tank which can be applied to the invention will now be described with reference to FIGS. 4A, 4B, and 5. FIGS. 4A and 4B are external perspective view of a head holder 200 having the ink tank 7 and the recording head 1. In FIGS. 4A and 4B, FIG. 4A shows the state where the ink tank 7 has been removed from the head holder 200 and FIG. 4B shows the state where the ink tank 7 has been attached to the head holder 200. FIG. 5 is a side sectional view showing an internal structure of the ink tank 7.

The ink tank 7 has a memory section (not shown) which can store the information such as a consumed ink amount and the like. The information from the recording apparatus can be written into the memory section at predetermined timing through a memory contact section (not shown) provided on the carriage. The ink tank 7 has almost a rectangular parallelepiped shape. An atmosphere communication port 120 as a hole communicating with the inside of the ink tank is formed in an upper wall 7U of the ink tank 7.

An ink supply tube 140 having an ink supply port is formed in a lower wall 7B of the ink tank 7 so as to be projected like a tube. In a physical distribution process, the atmosphere communication port 120 has been sealed with a film or the like. The ink supply tube 140 is sealed by being closed by a cap as an ink supply port sealing member. Reference numeral 160 is a lever member which is integratedly molded in the outside of the ink tank 7 so as to be freely elastically deformed. A projection for retaining is formed in an intermediate portion of the lever member 160.

Reference numeral 200 is the head holder which is formed integratedly with the recording head and to which the ink tank 7 is attached (refer to FIGS. 4A and 4B). For example, the ink tanks 7 (7C, 7M, 7Y) of the colors of cyan (C), magenta (M), and yellow (Y) are enclosed in the head holder 200. The recording head 1 to discharge the ink of each color is integratedly attached to a lower portion of the head holder 200. It is also possible to attach only an ink tank in which black (Bk) ink has been enclosed to the head holder and construct a recording head only for use in monochromatic recording. A window is formed in the bottom portion of the head holder 200 so that an ink presence/absence detecting section (specifically speaking, the prism 180), which will be explained hereinafter, can detect the presence or absence of the remaining ink in cooperation with the optical unit 14 and the remaining ink amount detecting section 25.

A plurality of discharge ports are downwardly formed in the recording head 1 (hereinbelow, the surface of the head in which the discharge ports have been formed is called "discharge port forming surface"). The ink tank 7 is attached to the head holder 200 from the state shown in FIG. 4A. In more detail, the ink supply tube 140 is come into engagement with an ink supply tube receiving section (not shown) provided for the recording head 1 and further depressed so that an ink path tube of the recording head 1 enters the ink supply tube 140. Thus, a projection for retaining 160A of the lever member 160 is come into engagement with a projection (not shown) formed in a predetermined position of the head holder 200 and the normal attaching state shown in FIG. 4B is obtained. The head holder 200 of the head integrated type in the state where the ink tank 7 has been attached is further mounted to, for example, the carriage 2 of the recording apparatus as shown in FIG. 1, so that a printable state is obtained. In such a state, a predetermined head difference (H) is formed between the bottom portion of the ink tank 7 and the discharge port forming surface of the head.

An internal structure of the ink tank 7 will now be described with reference to FIG. 5. The upper portion of the ink tank 7 is communicated with the atmosphere through the atmosphere communication port 120. The ink tank 7 has therein: a negative pressure generating member enclosing chamber 340 for enclosing an absorber 320 serving as a negative pressure generating member; and the liquid enclosing chamber (ink enclosing chamber) 360 which encloses the liquid ink and has substantially been sealed. Both of the negative pressure generating member enclosing chamber 340 and the liquid enclosing chamber 360 are partitioned by a partition wall 380. Both of them are communicated near the bottom portion of the ink tank 7 only through a communication port 400. Further, the negative pressure generating member enclosing chamber 340 is communicated with the ink supply tube 140 for supplying the ink to the recording head.

A plurality of ribs 420 are integratedly molded to the upper wall 7U of the ink tank 7 forming the negative pressure generating member enclosing chamber 340 so as to be projected to the inside of the ink tank. The ribs 420 are in contact with the absorber 320 which is enclosed in a compressing state in the negative pressure generating member enclosing chamber 340. In this manner, an air buffer chamber 440 is formed between the upper wall 7U and the upper surface of the absorber 320. The absorber 320 is made of a thermo compression urethane foam and enclosed in the negative pressure generating member enclosing chamber 340 in the compressing state so as to generate a predetermined capillary force, as will be explained hereinafter. An absolute value of a pore size of the absorber 320 to generate the predetermined capillary force differs depending on the kind of ink which is used, dimensions of the ink tank 7, a position (head difference H) of the discharge port forming surface of the recording head 1, and the like.

A disk-shaped or columnar pressure contact member 460 is arranged in the ink supply tube 140 forming an ink supply port 140A. The pressure contact member 460 is made of, for example, a felt of polypropylene. The pressure contact member itself is not easily deformed by an external force. In the state shown in FIG. 4A where the ink tank is not attached to the head holder 200, the pressure contact member 460 is held in the state where it has been pressed into the absorber 320 so as to locally compress the absorber 320. Therefore, a flange which is in contact with a periphery of the pressure contact member 460 is formed in an edge portion of the ink supply tube 140.

When the ink in the absorber 320 is consumed in the ink tank as shown in FIG. 5, the ink is supplied from the liquid enclosing chamber 360 to the absorber 320 in the negative pressure generating member enclosing chamber 340 through the communication port 400. Although a pressure in the liquid enclosing chamber 360 is reduced at this time, the air which entered the negative pressure generating member enclosing chamber from the atmosphere communication port 120 is supplied into the liquid enclosing chamber 360 through the communication port 400 of the partition wall 380, so that the pressure reduction in the liquid enclosing chamber 360 is lightened. Therefore, even if the ink is consumed, the absorber 320 is filled with the ink in accordance with the consumed ink amount. Since the absorber 320 holds the predetermined amount of ink and keeps the negative pressure to the recording head 1 almost constant, the ink supply to the recording head 1 becomes stable. After that, when the ink in the liquid enclosing chamber 360 is consumed, the ink in the absorber 320 is consumed.

Therefore, by providing the prism 180 serving as a part of the remaining ink amount detecting mechanism for the liquid enclosing chamber 360 of the ink tank as mentioned above, the user can detect that the ink in the liquid enclosing chamber 360 has been consumed, so that the user can be notified that the ink has been exhausted.

In the embodiment, the prism 180 functions as an ink presence/absence detecting section mentioned above.

The prism 180 has a shape of a triangular prism as an isosceles triangle whose vertical angle is equal to 90°. Therefore, if a length (a) of the bottom side of the isosceles triangle and a length (b) in the prismatic direction (direction perpendicular to the paper in FIG. 5) are known, an area (S) a prism oblique surface exposed in the ink tank 7 is equal to (/2)×a×b.

By providing the ink presence/absence detecting section (for example, prism) for the ink tank as mentioned above, the optical detection in which the error is smaller than that in the remaining amount detection by the consumed ink amount calculating means (hereinbelow, referred to as "data arithmetic operation detection") can be performed. However, the optical detecting mechanism is not always perfect but there is a case where an erroneous detection occurs. That is, as mentioned above, if the coloring agent is adhered to the prism, in spite of the fact that no ink remains in the liquid enclosing chamber of the ink tank, it is determined that the ink exists. If the presence of the ink is determined in spite of the absence of the ink, the apparatus cannot notify the user that the ink has been exhausted.

Figure 7:
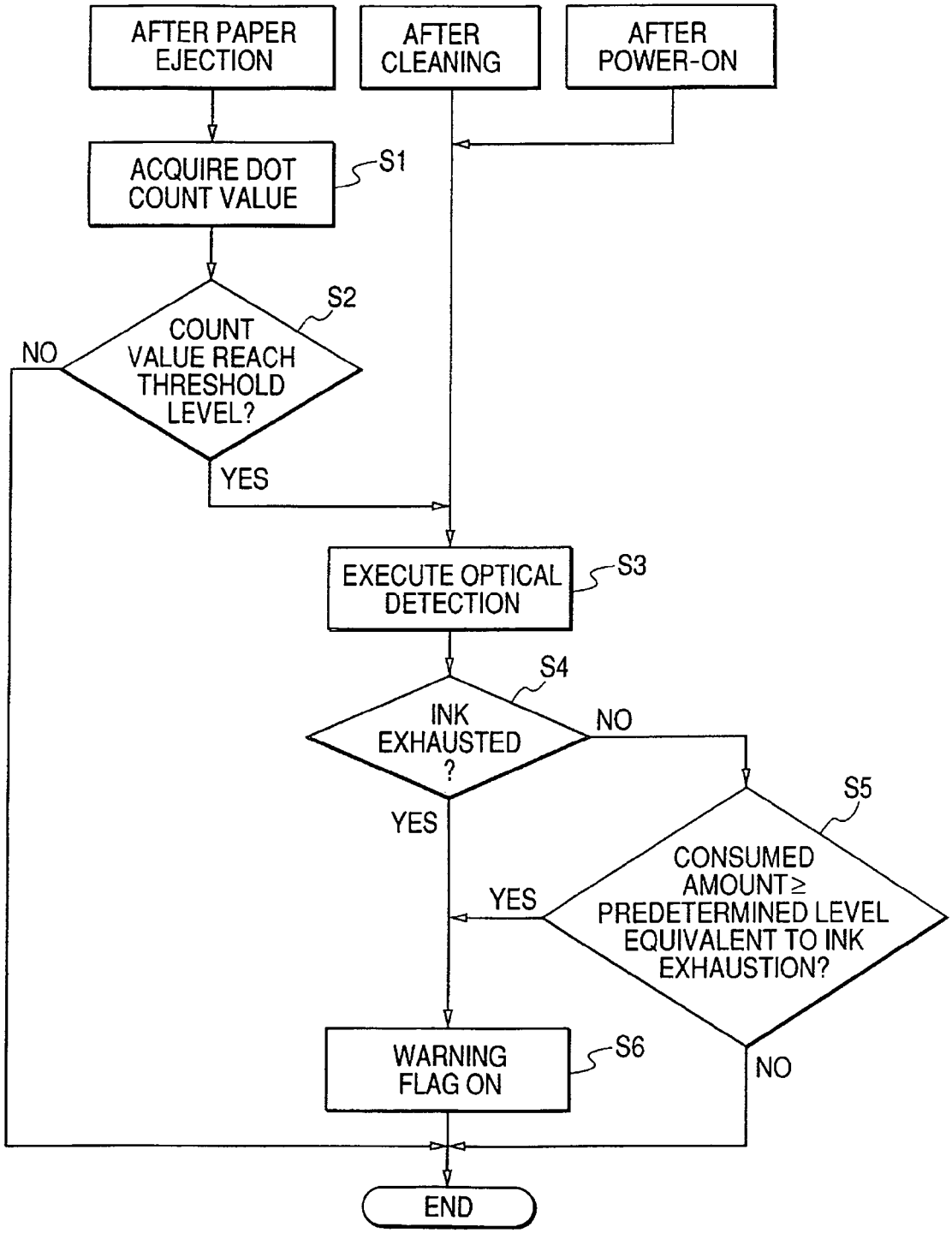
FIG. 7 is a flowchart showing a procedure for detecting the presence or absence of the ink in a liquid enclosing chamber 360.

In the embodiment, in order to make it possible to notify the user of the ink exhaustion even if such an erroneous detection occurred, in addition to the optical detecting mechanism, the data arithmetic operation detecting mechanism is also used, thereby discriminating the presence or absence of the ink. Specifically speaking, as shown in FIG. 7, even when the presence of the ink has been determined by the optical detecting mechanism, if the absence of the ink is decided by the data arithmetic operation detecting mechanism, the absence of the ink is notified. In this manner, such a construction that the optical detecting mechanism is relied and thus the optical detection result is immediately used is not applied, but the absence of the ink is discriminated in consideration of the result of the data arithmetic operation detection. The discrimination of the remaining ink amount by the optical detecting mechanism and the data arithmetic operation detecting mechanism which are characteristic in the embodiment will be described hereinbelow with reference to FIG. 7.

FIG. 7 is a flowchart showing a procedure for detecting the presence or absence of the ink in the liquid enclosing chamber (ink enclosing chamber) 360 in the embodiment. The ink presence/absence detection in the embodiment is performed at timing when a power source is turned on, timing after cleaning, and timing after paper ejection. When the power source is turned on and after the cleaning, the ink presence/absence detection by the optical detection is unconditionally performed (step S3). With respect to the timing after the paper ejection, the ink presence/absence detection may be performed every page after the paper ejection. However, the ink presence/absence detection by the optical detection is executed only in a special situation here (step S3). That is, in order to avoid a decrease in throughput by the ink presence/absence detection, the optical detection is executed only as necessary through the processes of steps S1 and S2 in FIG. 7. Specifically speaking, a dot count value which is counted by the gate array 1704 in FIG. 2 is acquired (step S1). Whether or not the acquired count value has reached a predetermined threshold value is discriminated (step S2). If the count value has reached the threshold value, the ink presence/absence detection by the optical detection is executed (step S3).

In the recording apparatus of the embodiment, the number of dots in the case where about one sheet of solid painted image has been printed to the whole surface of the recording paper of A4 as a maximum size is set as a threshold value. If the count value does not reach the threshold value in step S2, the ink presence/absence detection is not executed and the processing routine is finished. If the count value has reached the threshold value in step S2, the ink presence/absence detection is executed (step S3).

If it is determined that no ink exists in the liquid enclosing chamber 360 in the ink tank 7 as a result of the ink presence/absence detection in step S3, a remaining ink amount warning flag is set to ON in step S6 and the processing routine is finished. On the basis of information of the remaining ink amount warning flag, the user is notified that the ink in the ink tank has been exhausted through the display section having the LED lamp 1712 of various colors (refer to FIG. 2). Specifically speaking, a message "There is no ink. Exchange the ink tank." or the like is displayed on the display section, or the information of the remaining ink amount warning flag is supplied to a host apparatus through the interface 1700 shown in FIG. 2 and the user is notified of such an instruction through a display screen of the host apparatus on the basis of the information of the remaining ink amount warning flag.

If it is decided in step S4 that the ink exists in the liquid enclosing chamber 360 in the ink tank, step S5 follows. In step S5, whether or not the value showing the consumed ink amount (specifically speaking, the amount of ink which is consumed in association with the recording operation and the recovery operation) which is calculated by the consumed ink amount calculating means has reached a predetermined level corresponding to the ink exhaustion is discriminated. Thus, if such a value has reached the predetermined level, the remaining ink amount warning flag is set to ON in step S6 and the processing routine is finished. That is, even when the presence of the ink has been determined by the optical detection, if the ink exhaustion is decided by the data arithmetic operation, the user is preventively notified of a warning of the ink exhaustion. Thus, even in the case where the coloring agent has been adhered onto the inner wall of the ink tank and the optical detection is not accurately performed, it is possible to early notify the user of the ink exhaustion. On the other hand, if the value corresponding to the consumed ink amount calculated by the consumed ink amount calculating means does not reach the predetermined level, the results of both of the optical detection and the data arithmetic operation indicate that the ink exists. In this case, since there is hardly a possibility of the occurrence of the ink exhaustion, the warning of the ink exhaustion is not made and the processing routine is finished as it is.

In the embodiment, as a method of notifying the user of the information indicative of the ink exhaustion, the method of displaying the ink exhaustion information onto the display section of the recording apparatus or the display section of the host apparatus connected to the recording apparatus has been used. However, the information indicative of the ink exhaustion is not limited to the display information but may be, for example, voice information.

In the embodiment, since the ink tank as shown in FIG. 5 has been used, even if the ink in the liquid enclosing chamber (ink enclosing chamber) 360 is exhausted, a small amount of ink remains in the negative pressure generating member enclosing chamber 340 in the ink tank. Therefore, the detection of the presence or absence of the ink in the liquid enclosing chamber 360 has almost the same meaning as that of the detection about whether or not the remaining ink amount in the ink tank is equal to or less than the predetermined amount when seen from the whole ink tank.

As described above, according to the embodiment, both of the means for discriminating the absence of the ink by using the optical sensor and the means for discriminating the absence of the ink on the basis of the consumed ink amount are used. Therefore, even if there has occurred such a situation that a part of the compositions of the liquid such as a coloring agent or the like has been adhered and remained onto the surface of the prism in the ink tank, so that the presence or absence of the remaining ink amount in the ink tank cannot be accurately detected, the inconvenience due to the optical detection can be recovered and the user can be stably notified of the remaining ink amount in the ink tank.

The presence or absence of the remaining ink amount in the liquid enclosing chamber (ink enclosing chamber) in the ink tank is optically detected in the foregoing embodiment. That is, whether or not the remaining ink amount is substantially equal to zero is discriminated. However, the invention is not limited to such an example. A point of time when it is possible to decide that the remaining ink amount is small can be also detected instead of detecting a point of time when the remaining ink amount is substantially equal to zero.

Although the ink tank having the absorber as shown in FIG. 5 has been used in the foregoing embodiment, the ink tank which can be applied to the invention is not limited to such an ink tank. An ink tank having no absorber can be also applied.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2005-199967 filed on Jul. 8, 2005, which is hereby incorporated by reference herein.

What is claimed is:

1. A recording apparatus for recording an image on a recording medium by applying ink which is supplied from an ink tank, comprising:

a first determining unit constructed to determine whether or not an ink remaining amount in the ink tank is equal to or less than a predetermined amount by using an optical sensor;

an obtaining unit constructed to obtain a value regarding an amount of ink consumed from the ink tank;

a second determining unit constructed to determine whether or not the ink remaining amount in the ink tank is equal to or less than the predetermined amount on the basis of the value obtained by the obtaining unit, responsive to a determination by said first determining unit that the ink remaining amount in the ink tank is more than the predetermined amount; and a notifying unit constructed to notify of information showing that the ink remaining amount in the ink tank is equal to or less than the predetermined amount if it is determined by either said first determining unit or said second determining unit that the ink remaining amount in the ink tank is equal to or less than the predetermined amount, wherein said notifying unit notifies of the information according to the preceding one of such determination results by the first determining unit and the second determining unit that the ink remaining amount in the ink tank is equal to or less than the predetermined amount.

2. An apparatus according to claim 1, wherein after it is determined by said first determining unit that the ink remaining amount in the ink tank is more than the predetermined amount, if it is determined by said second determining unit that the ink amount in the ink tank is equal to or less than the predetermined amount, said notifying unit notifies of the information showing that the ink amount in the ink tank is equal to or less than the predetermined amount.

3. An apparatus according to claim 1, wherein:

if it is determined by said first determining unit that the ink remaining amount in the ink tank is equal to or less than the predetermined amount, the information is notified by said notifying unit;

after it is determined by said first determining unit that the ink remaining amount in the ink tank is more than the predetermined amount, if it is determined by said second determining unit that the ink remaining amount in the ink tank is equal to or less than the predetermined amount, the information is notified by said notifying unit; and after it is determined by said first determining unit that the ink remaining amount in the ink tank is more than the predetermined amount, if it is determined by said second determining unit that the ink remaining amount in the ink tank is more than the predetermined amount, the information showing that the ink amount in the ink tank is equal to or less than the predetermined amount is not notified by said notifying unit.

4. An apparatus according to claim 1, wherein:

the ink tank has a negative pressure generating member enclosing chamber which is communicated with a supply path to supply the ink to a recording head for applying the ink onto said recording medium and is used to enclose a negative pressure generating member and an ink enclosing chamber which is communicated with the negative pressure generating member enclosing chamber and is used for enclosing the ink; and said first determining unit determines whether or not the ink remaining amount in the ink tank is equal to or less than the predetermined amount by determining the presence or absence of the ink in the ink enclosing chamber.

5. An apparatus according to claim 4, further comprising:

a light emitting device adapted to irradiate light to a prism provided in the ink enclosing chamber; and a light receiving device adapted to receive a reflection light from said prism, wherein said first determining unit determines the presence or absence of the ink in said ink enclosing chamber on the basis of a result of the receiving of the light receiving device.

6. An apparatus according to claim 1, wherein:

the value obtained by the obtaining unit corresponds to an amount of ink consumed by a recording operation.

7. An apparatus according to claim 1, further comprising a display section constructed to display the information showing that the ink amount in the ink tank is equal to or less than the predetermined amount, wherein said notifying unit allows said display section to display the information.

8. An apparatus according to claim 1, wherein:

said recording apparatus is connected to a host computer; and said notifying unit allows a display section of the host computer connected to said recording apparatus to display the information showing that the ink amount in said ink tank is equal to or less than the predetermined amount.

9. A recording apparatus for recording an image on a recording medium by applying ink which is supplied from an ink tank, comprising:

a first determining unit constructed to determine whether or not an ink remaining amount in the ink tank is equal to or less than a predetermined amount by using an optical sensor;

a calculating unit constructed to calculate a value corresponding to an amount of ink consumed from the ink tank; and a second determining unit constructed to determine whether or not the ink remaining amount in the ink tank is equal to or less than the predetermined amount on the basis of the value calculated by said calculating unit, responsive to a determination by said first determining unit that the ink remaining amount in the ink tank is more than the predetermined amount; and a notifying unit constructed to (A) notify of information showing that the ink remaining amount in the ink tank is equal to or less than the predetermined amount if it is determined by said first determining unit that the ink remaining amount in the ink tank is equal to or less than the predetermined amount and (B) notify of the information showing that the ink remaining amount in the ink tank is equal to or less than the predetermined amount, if it is determined by said second determining unit that the ink remaining amount in the ink tank is equal to or less than the predetermined amount after it is determined by said first determining unit that the ink remaining amount in the ink tank is more than the predetermined amount, wherein said notifying unit notifies of the information according to the preceding one of such determination results by the first determining unit and the second determining unit that the ink remaining amount in the ink tank is equal to or less than the predetermined amount.

10. A method of notifying information regarding a remaining amount of ink in an ink tank used in a recording apparatus, comprising:

a first determining step of optically determining whether or not the remaining amount of the ink in the ink tank is equal to or less than a predetermined amount by using an optical sensor;

an obtaining step of obtaining a value regarding an amount of ink consumed from the ink tank;

a second determining step of determining whether or not ink remaining amount of the ink in the ink tank is equal to or less than the predetermined amount on the basis of the value obtained by said obtaining step, responsive to a determination in said first determining step that the remaining amount of the ink in the ink tank is more than the predetermined amount; and a notifying step of notifying of information showing that the remaining amount of the ink in the ink tank is equal to or less than the predetermined amount if it is determined in either said first determining step or said second determining step that the remaining amount of the ink in the ink tank is equal to or less than the predetermined amount, wherein in the notifying step, the information is notified according to the preceding one of such determination results by the first determining step and the second determining step that the ink remaining amount in the ink tank is equal to or less than the predetermined amount.

11. A method of notifying information regarding a remaining amount of ink in an ink tank used in a recording apparatus, comprising:

a first determining step of determining whether or not the remaining amount of the ink in the ink tank is equal to or less than a predetermined amount by using an optical sensor;

a calculating step of calculating a value corresponding to an amount of ink consumed from the ink tank; and a second determining step of determining whether or not the remaining amount of the ink in the ink tank is equal to or less than the predetermined amount on the basis of the value calculated in said calculating step, responsive to a determination in said first determining step that the remaining amount of the ink in the ink tank is more than the predetermined amount; and a notifying step of (A) notifying of information showing that the remaining amount of the ink in the ink tank is equal to or less than the predetermined amount if it is determined in said first determining step that the remaining amount of the ink in the ink tank is equal to or less than the predetermined amount, and (B) notifying of the information showing that the remaining amount of the ink in the ink tank is equal to or less than the predetermined amount, if it is determined in said second determining step that the remaining amount of the ink in said ink tank is equal to or less than the predetermined amount after it is determined in said first determining step that the remaining amount of the ink is more than the predetermined amount, wherein in the notifying step, the information is notified according to the preceding one of such determination results by the first determining step and the second determining step that the ink remaining amount in the ink tank is equal to or less than the predetermined amount.

* * * * *